US006253576B1

(12) United States Patent
Herron et al.

(10) Patent No.: US 6,253,576 B1
(45) Date of Patent: Jul. 3, 2001

(54) PROCESS FOR THE PRODUCTION OF INTERMEDIATE PRESSURE OXYGEN

(75) Inventors: Donn Michael Herron, Fogelsville; Adam Adrian Brostow, Emmaus, both of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/437,917

(22) Filed: Nov. 9, 1999

(51) Int. Cl.[7] ..... F25J 1/00
(52) U.S. Cl. ..... 62/646; 62/652; 62/654
(58) Field of Search ..... 62/646, 652, 654

(56) References Cited

U.S. PATENT DOCUMENTS

| | | | | |
|---|---|---|---|---|
| 4,072,023 | * | 2/1978 | Springmann | 62/650 |
| 4,543,115 | * | 9/1985 | Agrawal et al. | 62/646 |
| 4,560,398 | | 12/1985 | Beddome et al. | 62/29 |
| 5,082,482 | * | 1/1992 | Darredeau | 62/646 |
| 5,341,646 | * | 8/1994 | Agrawal et al. | 62/646 |
| 5,355,681 | | 10/1994 | Xu | 62/25 |
| 5,355,682 | | 10/1994 | Agrawal et al. | 62/41 |
| 5,475,980 | * | 12/1995 | Grenier et al. | 62/654 |
| 5,586,451 | * | 12/1996 | Koeberle et al. | 62/654 |
| 5,669,237 | | 9/1997 | Voit | 62/646 |
| 5,685,173 | * | 11/1997 | De L'Isle et al. | 62/654 |

* cited by examiner

*Primary Examiner*—Ronald Capossela
(74) *Attorney, Agent, or Firm*—Willard Jones, II

(57) ABSTRACT

A process is provided for the production of intermediate pressure oxygen. Intermediate pressure is defined as a pressure range between about 15 psia and about 27 psia, and preferably between about 17 psia and about 23 psia. The process uses a double column cryogenic air separation system for the production of oxygen from air which includes a higher pressure column and a lower pressure column, wherein a nitrogen-enriched fraction from the higher pressure column is condensed by indirect heat exchange in a reboiler-condenser that provides at least a fraction of the boilup at the bottom of the lower pressure column. Oxygen is withdrawn from the lower pressure column as a liquid and vaporized. One portion of air is feed air to the higher pressure column and a another portion of air is at least partially condensed by indirect heat exchange with the vaporizing oxygen. The latter portion of air is at least partially condensed at a pressure less than the pressure of the feed air to the higher pressure column. The process is suitable for the production of intermediate pressure oxygen with a purity of at least about 85 mole %.

20 Claims, 8 Drawing Sheets

PROCESS FOR THE PRODUCTION OF INTERMEDIATE PRESSURE OXYGEN

CROSS-REFERENCE TO RELATED APPLICATIONS

Not Applicable

STATEMENT REGARDING FEDERALLY SPONSORED RESEARCH FOR DEVELOPMENT

Not Applicable

BACKGROUND OF THE INVENTION

The present invention pertains to the field of cryogenic air separation, and in particular to a process for the production and delivery of intermediate pressure oxygen from a cryogenic air separation plant.

There are typically two ways of delivering the oxygen produced from a cryogenic air separation plant. Historically, oxygen product was withdrawn as a vapor from the bottom of the lower pressure column of a double-column distillation system, warmed to ambient temperature, and either delivered to the user at very low pressure or compressed. This type of process is commonly referred to as a GOX-plant The maximum oxygen pressure that can be realized when oxygen is withdrawn as a vapor from the lower pressure column is severely limited. This is due to the desire to operate the lower pressure column at a pressure as close to atmospheric pressure as possible to maintain efficient operation. The maximum oxygen delivery pressure also has been reduced further by the recent use of low pressure drop structured packing. In practice, the maximum, efficient, oxygen delivery pressure is only around 17 psia when oxygen is withdrawn as a vapor from a lower pressure column near atmospheric pressure. A supplemental product compressor may be justified for oxygen pressures greater than about 17 psia.

Many disclosures in the literature are directed at improving the efficiency of oxygen producing plants that produce oxygen as a vapor from a lower pressure column. U.S. Pat. No. 5,669,237 (Voit) is one example which is applicable to the production of low purity oxygen. A notable feature of this patent is the use of a portion of feed air to provide boilup to the bottom of the lower pressure column.

More recently, it has become commonplace to withdraw liquid oxygen from the lower pressure column, raise the pressure of the oxygen by using either static head or a pump, and vaporize the oxygen by condensing some suitably pressurized stream. This method of oxygen delivery is referred to as LOX-Boil or pumped-LOX. An example of LOX-Boil is taught in U.S. Pat. No. 4,560,398 (Beddome, et al.); an example of pumped-LOX is taught in U.S. Pat. No. 5,355,682 (Agrawal, et al.).

Oxygen delivery using LOX-Boil or pumped-LOX is commonly accomplished by condensing a portion of the incoming pressurized air. The source for the pressurized air is the discharge of a main air compressor. Since the discharge pressure of the main air compressor is set by the operating pressure of the higher pressure column, a lower bound on the condensing air pressure is established. As a result, the lowest pressure at which oxygen may be produced efficiently is approximately 23 psia. Of course, oxygen may be produced efficiently at pressures greater than 23 psia by using a booster compressor to raise the pressure of the condensing air stream. The absolute lowest efficient pressure may vary somewhat from 23 psia, depending on many factors such as: pressure of the lower pressure column, pressure drop in the distillation columns, heat exchanger temperature approaches, feed and product pressure drops, etc.

Many disclosures in the literature are directed at improving the efficiency of LOX-Boil and pumped-LOX plants. One example is U.S. Pat. No. 5,355,681 (Xu), which is applicable to the coproduction of liquid products. A key feature of one of the embodiments (as illustrated in FIG. 1 of U.S. Pat. No. 5,355,681) is the use of a portion of feed air to provide boilup to the bottom of the lower pressure column.

It is desired to provide an efficient process for producing oxygen from a cryogenic air separation plant at a pressure intermediate that which is achievable by either withdrawing vapor from the lower pressure column or by vaporizing liquid oxygen against a stream of air which is nominally at the pressure of the higher pressure column.

BRIEF SUMMARY OF THE INVENTION

The present invention is a process for the production and delivery of intermediate pressure oxygen from a cryogenic air separation plant.

The first embodiment of the invention is a process for separating air to produce oxygen at a intermediate pressure. The process uses a higher pressure column and a lower pressure column in thermal communication with the higher pressure column through a main reboiler-condenser. Each column has a top and a bottom, and the main reboiler-condenser provides at least a fraction of boilup at the bottom of the lower pressure column. The process includes multiple steps. The first step is to provide a first stream of compressed air. The second step is to divide the first stream of compressed air into a first portion of air and a second portion of air. The third step is to feed the first portion of air to the higher pressure column at a first pressure. The fourth step is to withdraw a stream of liquid oxygen from the lower pressure column. The fifth step is to heat exchange the stream of liquid of oxygen with the second portion of air, said second portion of air being at a second pressure lower than the first pressure, thereby at least partially condensing the second portion of air and at least partially vaporizing the stream of liquid oxygen.

In one variation of the first embodiment, the second pressure is lower than the first pressure by about 7 psia to about 8 psia.

A second embodiment of the invention includes the same multiple steps of the first embodiment, but includes three additional steps. The first additional step is to withdraw a third portion of air from the first portion of air or from the second portion of air. The second additional step is to expand the third portion of air. The third additional step is to feed the expanded third portion of air to the lower pressure column.

A third embodiment of the invention is similar to the first embodiment, but includes three additional steps. The first additional step is to withdraw an oxygen-enriched stream of liquid from the bottom of the higher pressure column. The second additional step is to feed at least a portion of the oxygen-enriched stream of liquid to the lower pressure column. The third additional step is to withdraw a nitrogen-enriched stream of vapor from the top of the lower pressure column.

A fourth embodiment of the invention is similar to the first embodiment, but includes four additional steps. The first additional step is to withdraw a nitrogen-enriched stream from the higher pressure column. The second additional step is to expand at least a portion of the nitrogen-enriched stream. The third additional step is to condense the at least a portion of the nitrogen-enriched stream. The fourth additional step is to feed at least a portion of the condensed at least a portion of the nitrogen-enriched stream to the lower pressure column.

A fifth embodiment of the invention is similar to the fourth embodiment, but includes three additional steps. The first additional step is to withdraw an oxygen-enriched stream from the bottom of the higher pressure column. The second additional step is to vaporize at least a portion of the oxygen-enriched stream by heat exchanging said at least portion of oxygen-enriched stream with the at least a portion of the nitrogen-enriched stream. The third additional step is to feed the vaporized at least a portion of the oxygen-enriched stream to the lower pressure column.

A sixth embodiment of the invention is similar to the first embodiment, but includes four additional steps. The first additional step is to withdraw a nitrogen-enriched stream from the top of the higher pressure column. The second additional step is to condense the nitrogen-enriched stream in a reboiler-condenser. The third additional step is to return a first portion of the condensed nitrogen-enriched stream to the higher pressure column. The fourth additional step is to feed a second portion of the condensed nitrogen-enriched stream to the lower pressure column.

A seventh embodiment of the invention is similar to the first embodiment, but includes two additional steps. The first additional step is to warm a vaporized portion of the at least partially vaporized stream of liquid oxygen. The second additional step is to deliver the warmed vaporized portion to an end user.

There are several variations of the seventh embodiment. In one variation, the vaporized portion is delivered at a pressure between about 15 psia and about 27 psia, and preferably between about 17 psia and about 23 psia. In another variation, the vaporized portion has a purity of at least about 85 mole %.

There also are many variations of the first embodiment. In one variation, the stream of liquid oxygen withdrawn from the lower pressure column is elevated in pressure before being vaporized. In another variation, the first portion of air is compressed from the second pressure to the first pressure and is cooled before being fed to the higher pressure column. In addition, there are several variants of this latter variation. In one variant, at least some of the energy for further compressing the first portion of air is supplied by turbo-expanding another stream. In another variant, the first portion of air is further compressed at a temperature colder than an ambient temperature. In a variation of the latter variant, at least some of the energy for further compressing the first portion of air is supplied by turbo-expanding another stream.

In another variation of the first embodiment, the second portion of air is lowered to the second pressure by a turbo-expander. In one variant of this variation, the second portion of air entering the turbo-expander is at a temperature warmer than an ambient temperature. In another variant, the second portion of air is cooled before entering the turbo-expander.

Another aspect of the present invention is a cryogenic air separation unit using any of the processes of the present invention. For example, one embodiment is a cryogenic air separation unit using a process as in the first embodiment.

BRIEF DESCRIPTION OF THE DRAWINGS

The invention will be described by way of example with reference to the accompanying drawings in which.

DETAILED DESCRIPTION OF THE INVENTION

The present invention provides an efficient process for the production of intermediate pressure oxygen. Intermediate pressure is defined as a pressure between about 15 psia and about 27 psia, and preferably between about 17 psia and about 23 psia. Though this intermediate pressure range may appear rather narrow, it is nonetheless commercially important. For example, the present invention is applicable to oxygen supply for waste water treatment. The present invention is suitable for the production of oxygen with a purity greater than 85 mole %.

The present invention uses a double column cryogenic air separation system for the production of oxygen which comprises a higher-pressure column and a lower-pressure column, wherein a nitrogen-enriched fraction from the higher pressure column is condensed by indirect heat exchange in a reboiler-condenser that provides at least a fraction of the boilup at the bottom of the lower pressure column. Oxygen is withdrawn from the lower pressure column as a liquid and vaporized. One portion of air is feed air to the higher pressure column and another portion of air is at least partially condensed by indirect heat exchange with the vaporizing oxygen. The latter portion of air is at least partially condensed at a pressure less than the pressure of the feed air to the higher pressure column.

Figure 1:
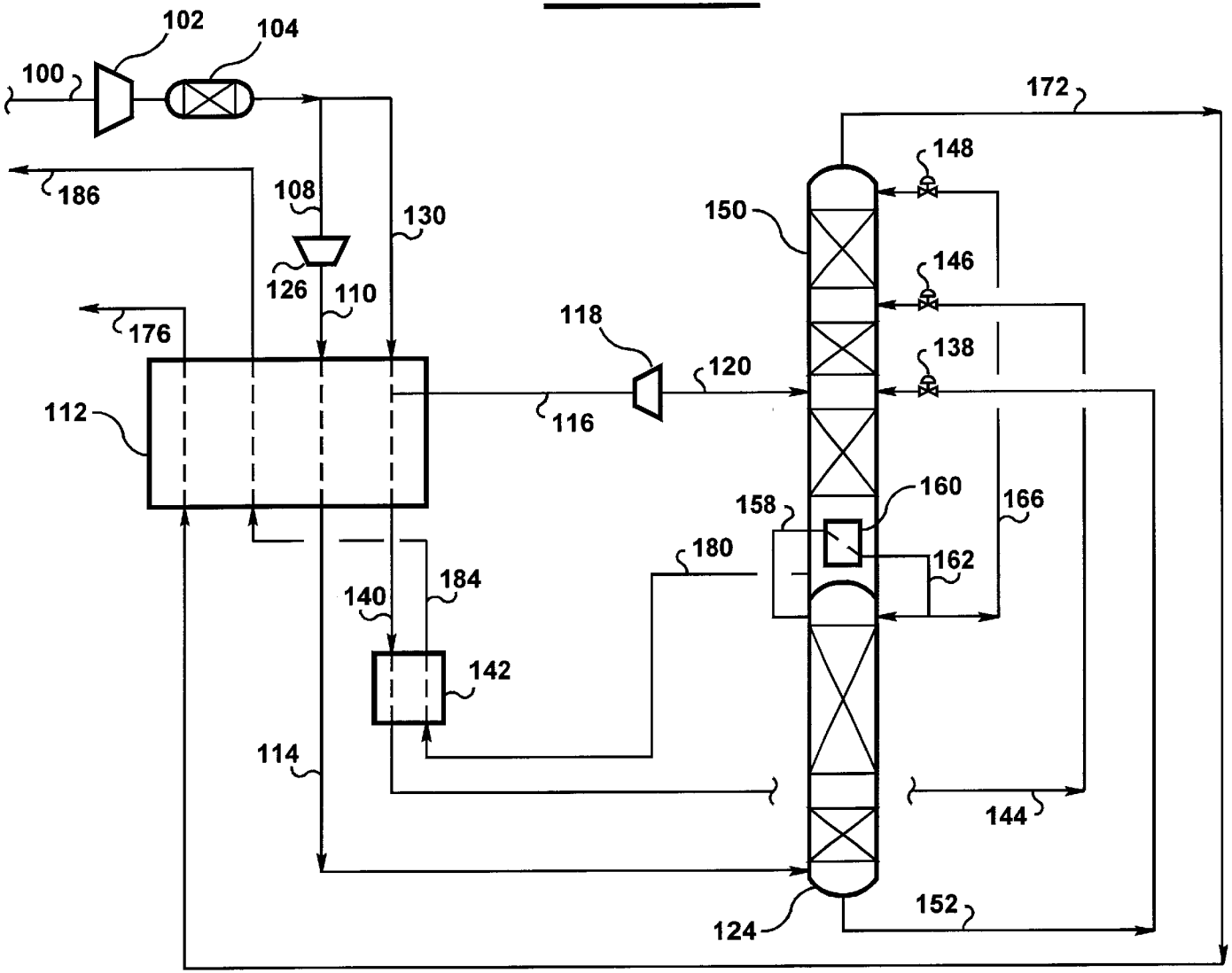
FIG. 1 is a schematic diagram of an embodiment of the present invention.

One embodiment of the present invention is shown in FIG. 1. Atmospheric air 100 is compressed in the main air compressor 102, purified in adsorbent bed 104 to remove impurities such as carbon dioxide and water, then divided into two fractions—stream 130 and stream 108. Stream 108 is compressed in supplemental air compressor 126 to form stream 110, which is cooled in main heat exchanger 112 to become stream 114, the feed air to the higher pressure column 124. After stream 130 is cooled to a temperature intermediate the warm and cold end of the main heat exchanger, a fraction is extracted as stream 116, which is fed to turbo-expander 118. The remainder of stream 130 is further cooled to become stream 140, which is fed to vaporizer 142. Stream 116 is expanded in turbo-expander 118 to provide refrigeration for the plant, then introduced into the lower pressure column 150 as stream 120. Stream 140 is at least partially condensed in vaporizer 142 to form stream 144, which is reduced in pressure across valve 146 and introduced to the lower pressure column 150.

The higher pressure column 124 produces a nitrogen-enriched stream 158 from the top, and an oxygen-enriched stream 152 from the bottom. Stream 158 is condensed in reboiler-condenser 160 to form stream 162. A portion of stream 162 is returned to the higher pressure column as reflux; the remainder, stream 166, after eventually being reduced in pressure by valve 148, is introduced to the lower pressure column 150 as the top feed to that column. Oxygen-enriched stream 152, after eventually being reduced in pressure by valve 138, also is introduced to the lower pressure column.

The lower pressure column 150 produces oxygen from the bottom, which is withdrawn as liquid stream 180, and a nitrogen-rich stream 172, which is withdrawn from the top. Nitrogen-rich stream 172 is warmed in main heat exchanger 112 and discharged to atmosphere as stream 176. Boilup for the bottom of the lower pressure column is provided by reboiler-condenser 160. The liquid oxygen stream 180 is directed to vaporizer 142 and is vaporized to form stream 184, which is warmed in the main heat exchanger to form product stream 186.

The pressures of stream 114 and stream 140 vary depending on a number of operating constraints, such as: oxygen product purity, oxygen product pressure, and plant pressure drops. For the purpose of illustration, it will be assumed that the pressures at the top and bottom of the lower pressure column 150 are 18 psia and 19.5 psia, respectively, and that a typical reboiler-condenser temperature difference is 2° F. For 99.9 mole % purity oxygen, the pressure at the top of the higher pressure column 124 would be approximately 73 psia; and for 90 mole % purity oxygen, the pressure at the top of the higher pressure column would be approximately 62 psia. Assuming further that the pressure drop from bottom to top in the higher pressure column is 1 psia, the pressure of stream 114 would range between 63 psia and 74 psia.

By contrast, the pressure of the condensing stream 140 is determined by the oxygen vaporizing pressure. For an oxygen purity of 99.9 mole %, an oxygen vaporizing pressure of 21 psia in vaporizer 142, and a vaporizer minimum temperature difference of 2° F., the pressure of stream 140 is approximately 66 psia; for an oxygen purity of 90 mole % and an oxygen vaporizing pressure of 21 psia, the pressure of stream 140 is approximately 56 psia. Thus, the difference between the higher pressure column feed pressure (i.e., the pressure of stream 114 at 63–74 psia) and the condensing air pressure (i.e., the pressure of stream 140 at 56–66 psia) is approximately 7 psia to 8 psia and largely independent of oxygen purity. As would be expected, when the oxygen vaporizing pressure increases, the pressure of stream 140 also increases.

Figure 2:
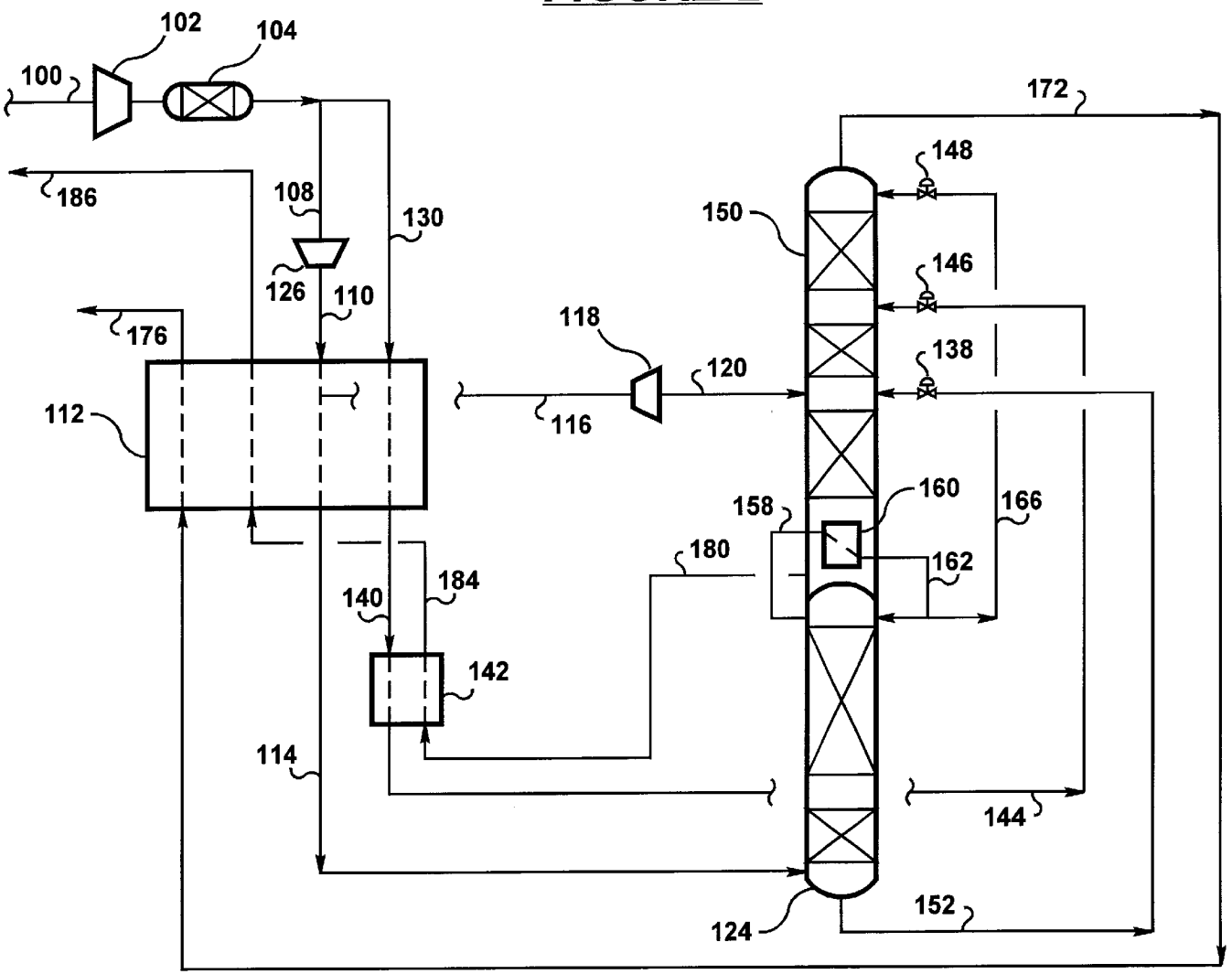
FIG. 2 is a schematic diagram of another embodiment of the present invention.

FIG. 2 shows another embodiment of the present invention. Circuits common with FIG. 1 are not discussed with regard to FIG. 2. The only change in FIG. 2 is that stream 116 is withdrawn from the higher pressure air feed stream 110, rather than from stream 130.

Figure 7:
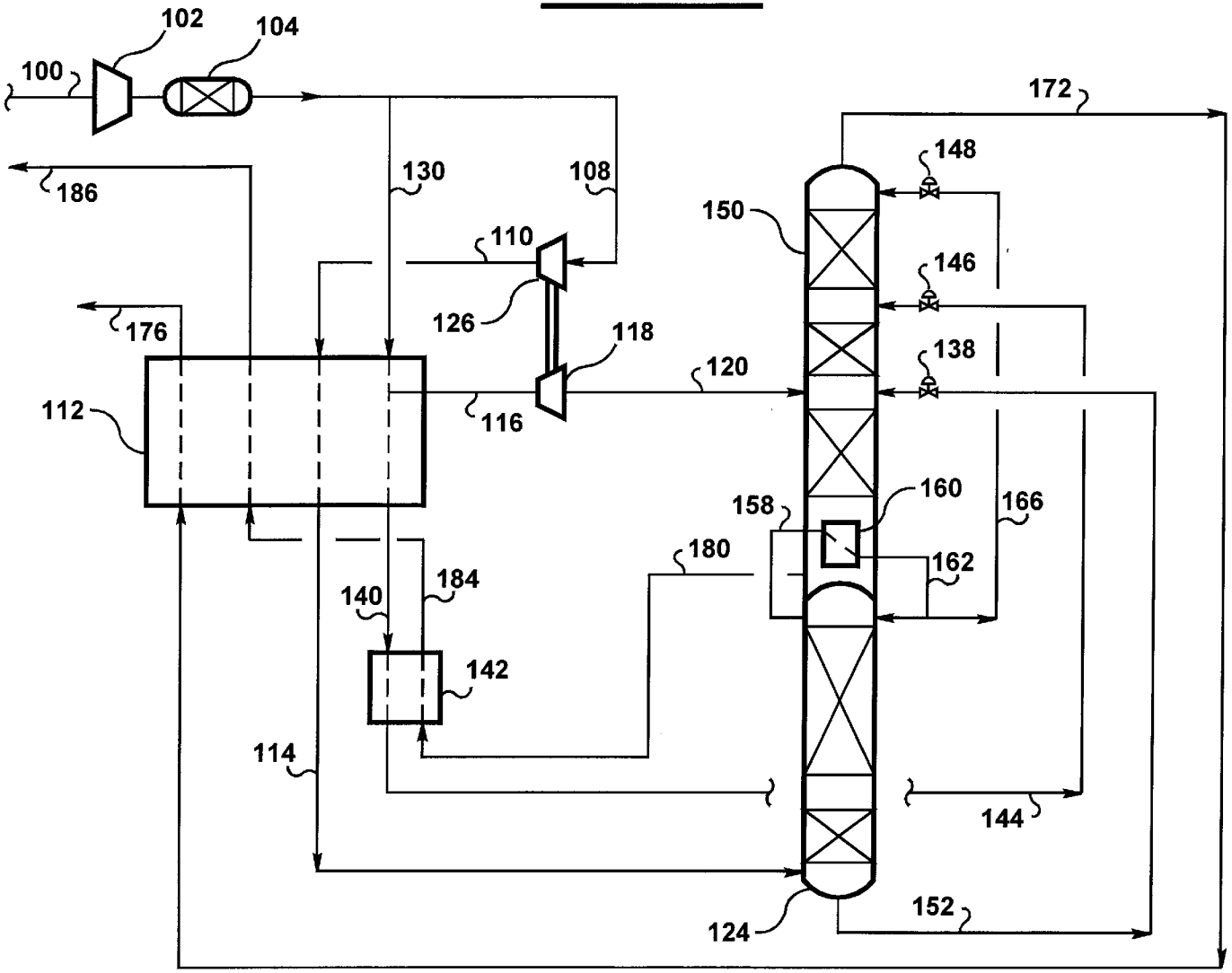
FIG. 7 and 8 are schematic diagrams of an embodiment of the present invention illustrating two different compander configurations.

The pressure of stream 116 is largely variable. As shown in the embodiment illustrated in FIG. 1, stream 116 is essentially at the same pressure as that of the condensing stream 140. The withdrawal of stream 116 from this location (i.e., from stream 130) is preferred when the refrigeration demand is low and/or when lower-purity oxygen is produced. In many cases, it may be possible to use the work extracted from turbo-expander 118 to drive the supplemental air compressor 126 (as shown in FIG. 7). Alternatively, as shown. FIG. 2, stream 116 may be withdrawn from the discharge of supplemental compressor 126, in which case the pressure of stream 116 is essentially the same pressure as that of stream 114. The withdrawal of stream 116 from this location is preferred when the refrigeration demand is higher and/or when higher-purity oxygen is produced.

Figure 3:
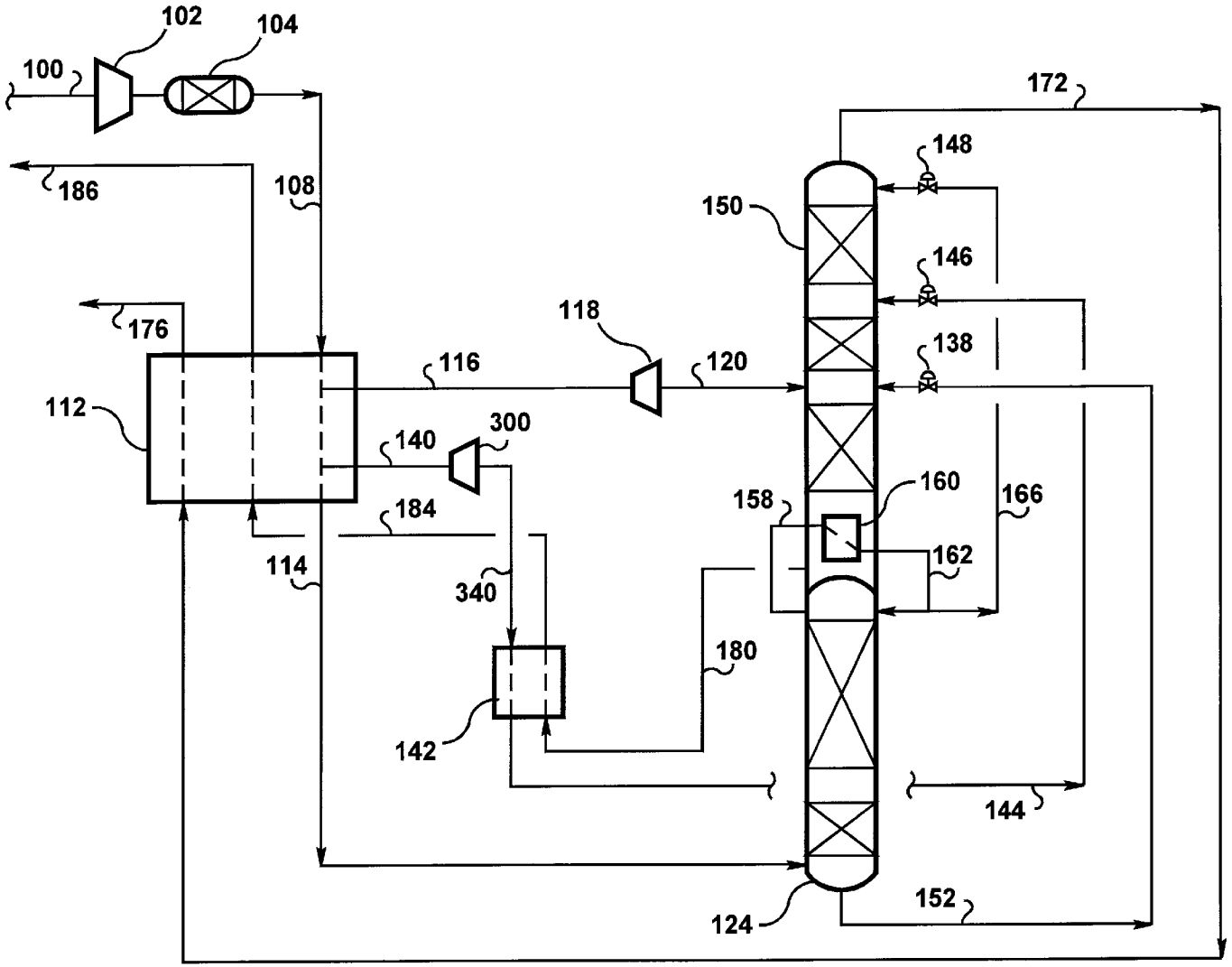
FIG. 3 is a schematic diagram of another embodiment of the present invention.

FIG. 3 shows another embodiment of the present invention. In this embodiment, the discharge of main air compressor 102 is determined by the pressure of the higher pressure column 124. This is in contrast with the embodiments of FIGS. 1 and 2 where the discharge pressure of main air compressor 102 is determined by the vaporizing oxygen pressure. Referring to FIG. 3, after stream 108 is partially cooled in the main heat exchanger 112, stream 116 is extracted from stream 108 and fed to turbo-expander 118. After the remaining portion of stream 108 is further cooled, another fraction of air is extracted as stream 140. Stream 140 is expanded in a second turbo-expander 300 to produce stream 340, which is at a pressure suitable to vaporize the oxygen in vaporizer 142. The second turbo-expander 300 produces additional refrigeration, as its shaft power can be recovered in an electric generator or used to compress another process stream. The embodiment illustrated in FIG. 3 is most suitable when the refrigeration demand is high—such as when coproduction of liquid products is called for.

Figure 4:
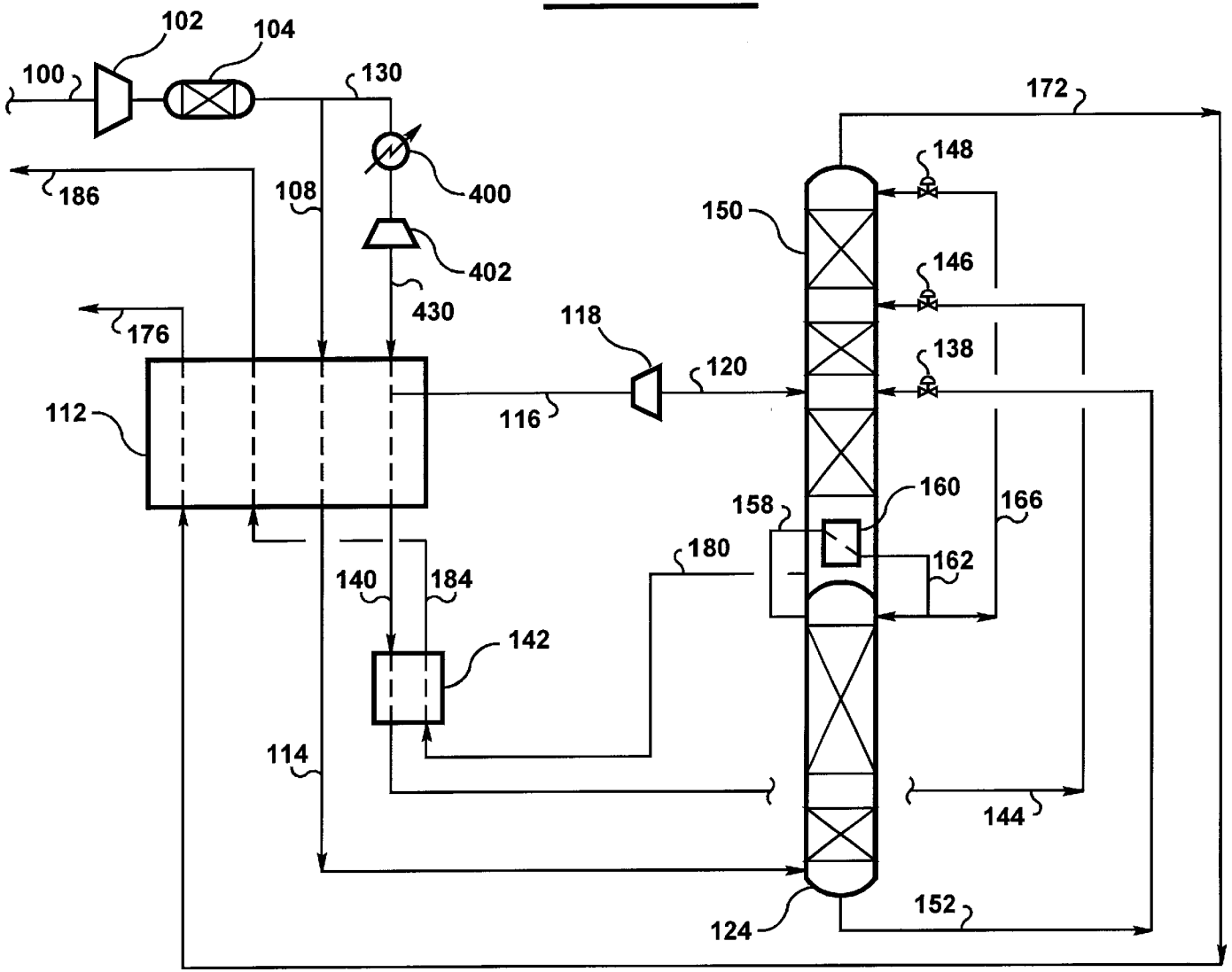
FIG. 4 is a schematic diagram of another embodiment of the present invention.

FIG. 4 shows a variation of the embodiment shown in FIG. 3. Stream 130 optionally is heated in heat exchanger 400 then expanded in turbo-expander 402 to generate power and/or shaft work. Heat exchanger 400 can be thermally integrated with a source of heat within the plant such as a hot compressor discharge. After stream 430 is partially cooled in the main heat exchanger 112, a fraction of the stream is extracted to produce stream 116, which is fed to turbo-expander 118. The remaining fraction is further cooled to produce stream 140, which is condensed in vaporizer 142.

Figure 5:
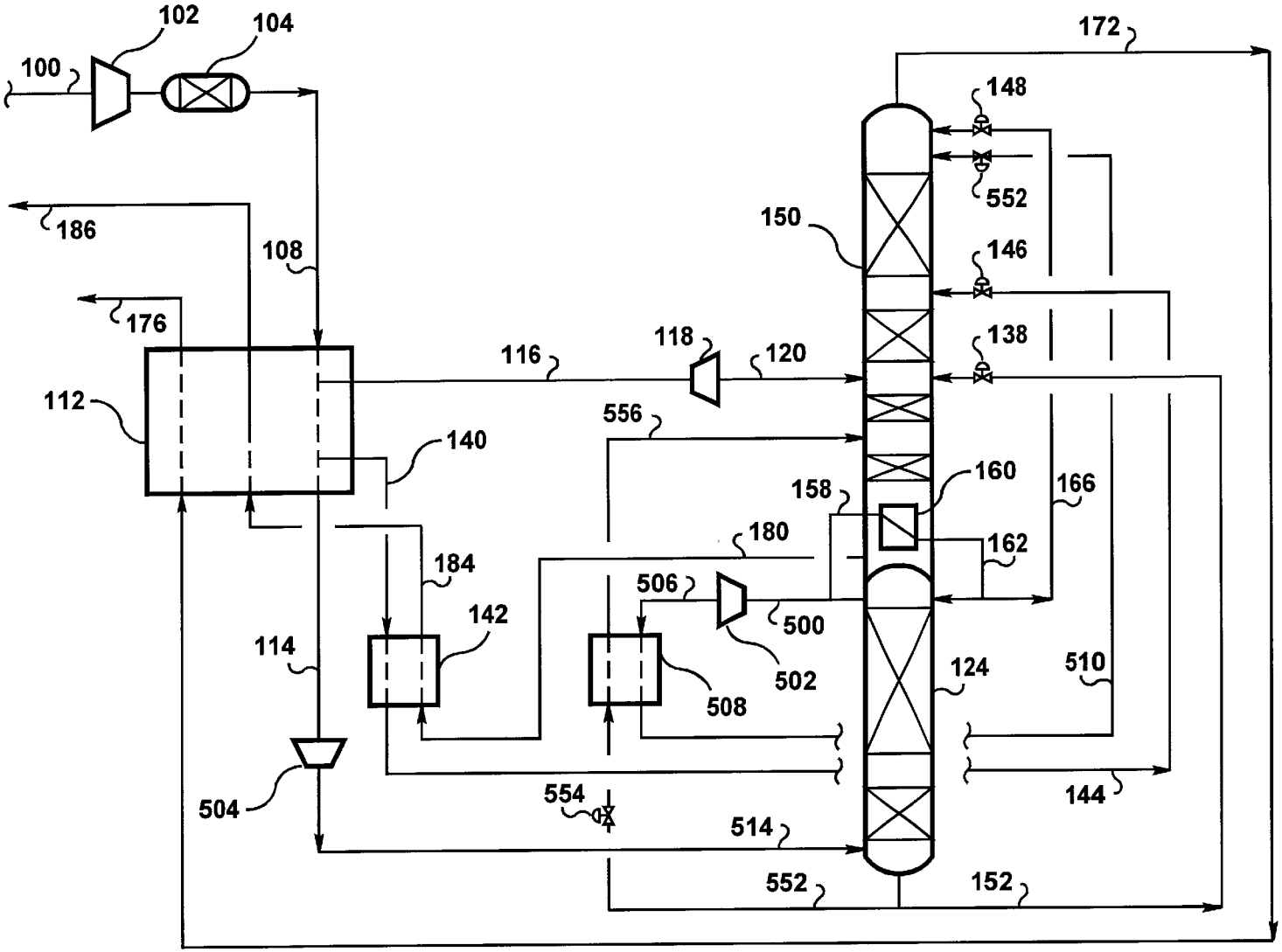
FIG. 5 is a schematic diagram of another embodiment of the present invention.

FIG. 5 shows another embodiment of the present invention which might be used for low purity oxygen production. As with the embodiment shown in FIG. 1, the discharge pressure of main air compressor 102 is determined by the oxygen vaporizing pressure. Stream 114, which is the cooled feed for the higher pressure column 124, is compressed in compressor 504 to form stream 514 at a pressure required to feed stream 514 to the higher pressure column. A nitrogen-enriched stream from the top of the higher pressure column is split into two portions, stream 158 and stream 500. Stream 158 is condensed in reboiler-condenser 160 to form stream 162. A portion of stream 162 is returned to the higher pressure column as reflux; the remainder, stream 166, after eventually being reduced in pressure by valve 148, is introduced to the lower pressure column 150 as the top feed to that column. Stream 500 is expanded in turbo-expander 502 to produce stream 506, which is condensed in condenser 508, then introduced into the lower-pressure column as stream 510 after eventually being reduced in pressure by valve 552. As an option, stream 500 may be warmed prior to its introduction to turbo-expander 502. An oxygenen-riched stream withdrawn from the bottom of the higher-pressure column is split into two streams—stream 152 and stream 552. Stream 152, after eventually being reduced in pressure by valve 138, is introduced to the lower pressure column. Stream 552 eventually is reduced in pressure across valve 554, vaporized in condenser 508 against condensing nitrogen stream 506, and introduced to the lower pressure column as feed 556.

Figure 8:
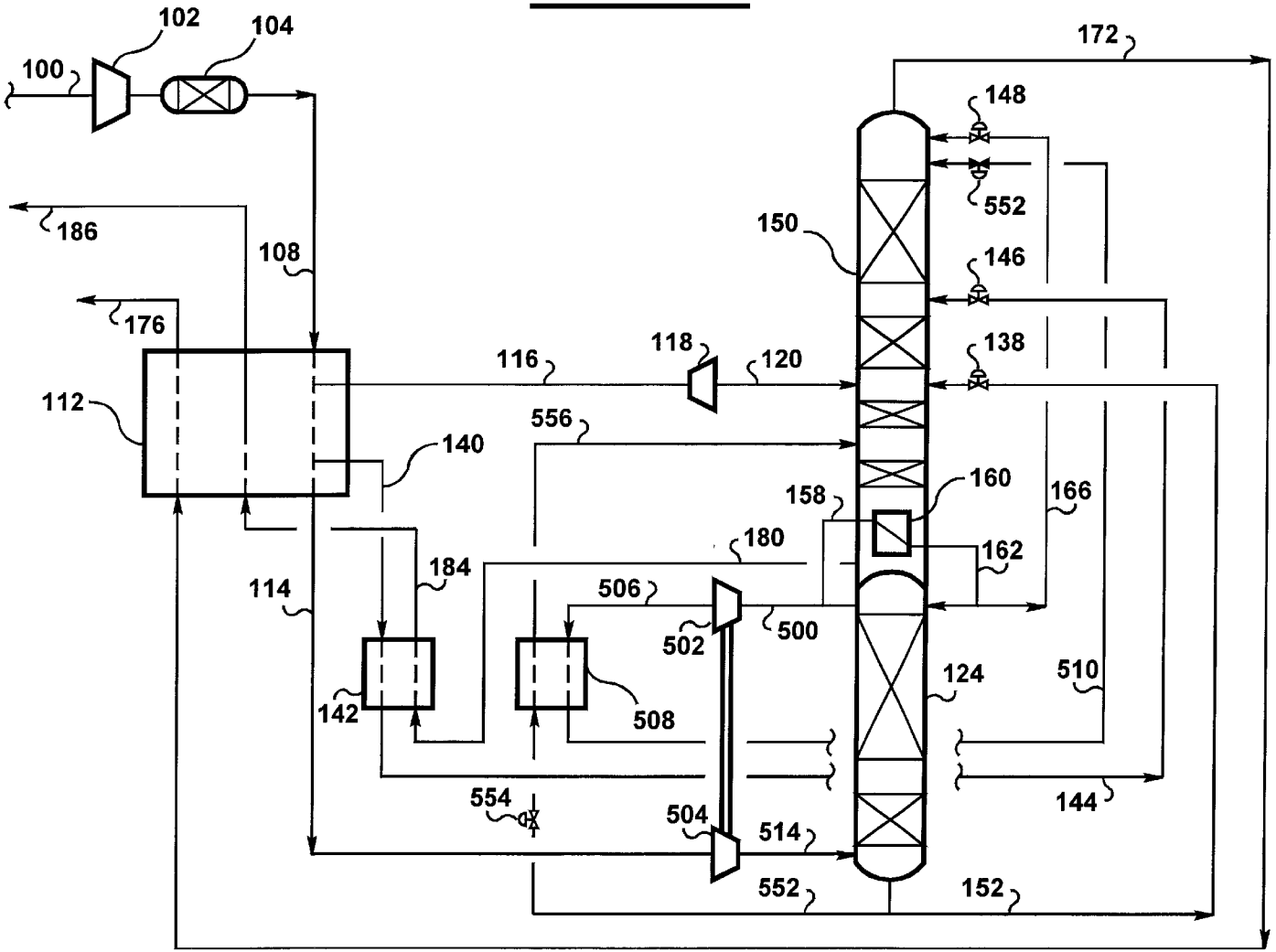

The energy needed to drive compressor 504 may be derived from a number of sources. Compressor 504 may be powered by an electric motor, it may be powered by turbo-expander 502 (as shown in FIG. 8), or it may be powered by turbo-expander 118. The optimal choice of a powering device for compressor 504 depends on the refrigeration requirement and the oxygen delivery pressure.

Figure 6:
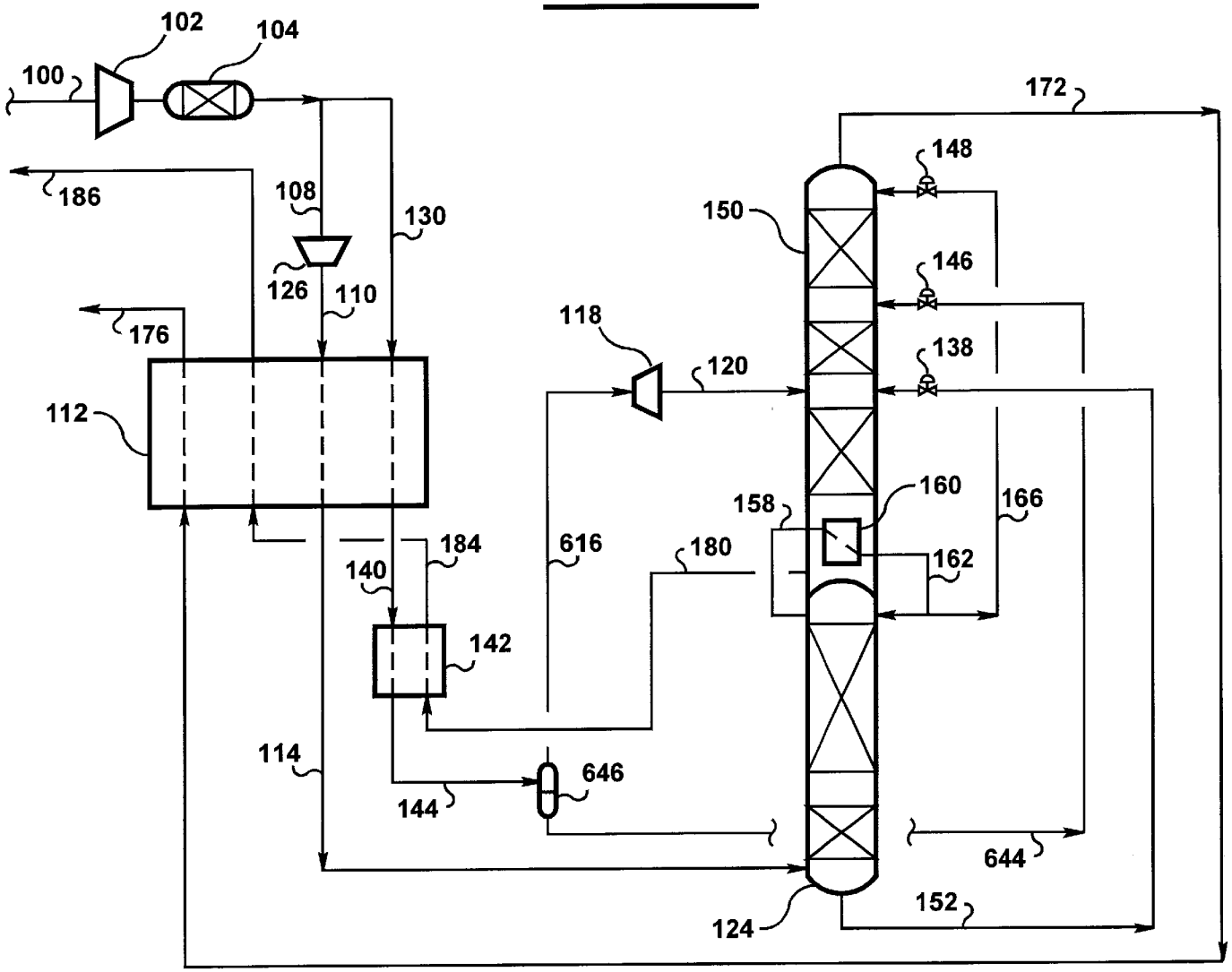
FIG. 6 is a schematic diagram of another embodiment of the present invention.

FIG. 6 shows a variation of the embodiment shown in FIG. 1. In this embodiment (FIG. 6), stream 140 is only partially condensed in vaporizer 142. Stream 144 is passed to a phase separator 646 which produces a vapor portion 616 and a liquid portion 644. The vapor portion is directed to turbo-expander 118, and the liquid portion eventually is reduced in pressure by valve 146 then fed to the lower pressure column 150. Stream 616 optionally may be warmed prior to expansion in turbo-expander 118. This embodiment is useful for maximizing the pressure of the vaporizing oxygen stream 184, since stream 144 is warmer if only partially condensed rather than totally condensed.

In FIGS. 1 through 6, none of the feed streams to the lower pressure column 150 are cooled prior to being reduced in pressure and introduced to the lower pressure column. The action of cooling lower pressure column feeds is commonplace and is accomplished by warming a low pressure gas stream, such as stream 172, in a heat exchanger called a subcooler. Inclusion of a subcooler in the embodiments of the present invention usually becomes justified as power cost increases and/or plant size increases.

The embodiments of the present invention also may include the coproduction of gaseous nitrogen product. For example, a portion of stream 172 could be withdrawn as nitrogen product. Alternatively, nitrogen product could be withdrawn directly from the top of the higher pressure column 124. When nitrogen coproduct is withdrawn from the top of the higher pressure column 124 it also is common practice to extract the lower pressure column reflux stream 166 from a position in the higher pressure column a number of stages below the top of the higher pressure column. In this event, all of reboiler-condenser condensate stream 162 is returned to the higher pressure column.

All the embodiments in FIGS. 1 through 6 show that the condensed air stream 144 is fed to the lower pressure column 150. It is possible, and often justified, to send a portion of the condensed air to both columns. This can be accomplished in a number of ways. For example, stream 144 may be subdivided into two streams, with one portion being sent to the lower pressure column 150 and the other portion being sent to the higher pressure column 124. Alternatively, all of stream 144 may be sent to the higher pressure column, and liquid may be withdrawn from the higher pressure column from the same location where stream 144 was introduced. A complication arises when attempting to send all or some of the condensed air to the higher pressure column—namely and by design, the pressure of condensed air stream 144 is less than the pressure of the higher pressure column. This is easily overcome either by pumping or by physically elevating vaporizer 142 so that the pressure of stream 144 may be increased through the use of static head of the liquid. Since the pressure difference between the condensed air stream and the higher pressure column is on the order of 8 psi or less, an elevation increase of about 30 feet would usually suffice.

In FIGS. 1 through 6, no mention was made as to how the pressure of liquid oxygen stream 180 is increased prior to being introduced to vaporizer 142. Any common means may be used, including but not limited to the use of a pump or physical elevation between the bottom of the lower pressure column 150 and the vaporizer 142 to build static head.

In FIGS. 1 through 6, vaporizer 142 is shown as a separate device. However, this exchanger may be integrated within the main heat exchanger 112, in which case the need for a separate vaporizer would be eliminated.

EXAMPLE

To demonstrate the efficacy of the present invention and to compare the present invention to prior art processes, the following example is presented. The basis for comparison follows:

1) Oxygen is desired at a minimum pressure of 19 psia and a purity of 90 mole %;
2) the bottom of the lower pressure column is 19.5 psia;
3) reboiler-condenser 160 temperature difference is 2° F.;
4) minimum temperature approach in vaporizer 142 is 2° F.;
5) pressure drop in the higher pressure column is 1 psia;
6) air feed pressure drops in the main heat exchanger 112 are 2 psia; and
7) oxygen pressure drop in the main heat exchanger 112 is 2 psia.

For the basis described, the pressure at the bottom of the higher pressure column 124 is 63 psia.

The present invention is illustrated by the embodiment shown in FIG. 1. For production of low purity oxygen (e.g, 90 mole %), the typical distribution of air feeds is: 50% is passed to higher pressure column 124 as stream 114; 28% is passed to vaporizer 142 as stream 140; and 22% is passed to turbo-expander 118 as stream 116. For an oxygen delivery pressure of 19 psia, the oxygen pressure at vaporizer 142 (stream 184) must be 21 psia, and consequently, the pressure of stream 140 must be 56 psia. The pressures of the two incoming air streams, 110 and 130, must be 65 psia and 58 psia, respectively. Approximately 50% of the incoming air is contained in these two streams. The power required to drive the air compression is assigned a value of 1.0.

In a conventional design wherein the oxygen is produced as a vapor from the lower pressure column 150 (a GOX-Plant), all of the air would need to enter the main heat exchanger 112 at 65 psia. Furthermore, the oxygen product would exit the main heat exchanger at only 17.5 psia. The power required to drive the air compression would be approximately 1.04 and the power to drive a supplemental oxygen pressure would be approximately 0.01. Thus, a GOX-Plant would require 5% more power than the embodiment of the present invention shown in FIG. 1.

In a conventional design wherein the oxygen is a liquid and is vaporized against incoming air which is at the pressure of the higher pressure column 124 (LOX-Boil), all of the air would still need to enter the main heat exchanger 112 at 65 psia. Because the condensing air pressure is higher than required, it would be feasible to produce oxygen product at 21.5 psia, but such excess pressure is not required. The power required to drive the air compression would be approximately 1.04. Therefore, a LOX-Boil process would require 4% more power than the embodiment of the present invention shown in FIG. 1.

Although illustrated and described herein with reference to certain specific embodiments, the present invention is nevertheless not intended to be limited to the details shown. Rather, various modifications may be made in the details within the scope and range of equivalents of the claims of the claims and without departing from the spirit of the invention.

What is claimed is:

1. A process for separating air to produce oxygen at an intermediate pressure, said process using a higher pressure column and a lower pressure column in thermal communication with the higher pressure column through a main reboiler-condenser, wherein each column has a top and a bottom, and wherein the main reboiler-condenser provides at least a fraction of boilup at the bottom of the lower pressure column, comprising the steps of:

providing a first stream of compressed air;

dividing the first stream of compressed air into a first portion of air and a second portion of air;

feeding the first portion of air to the higher pressure column at a first pressure;

withdrawing a stream of liquid oxygen from the lower pressure column; and heat exchanging the stream of liquid oxygen with the second portion of air, said second portion of air being at a second pressure lower than the first pressure, thereby at least partially condensing the second portion of air and at least partially vaporizing the stream of liquid oxygen.

2. A process as in claim 1, comprising the further steps of:

withdrawing a third portion of air from the first portion of air or from the second portion of air;

expanding the third portion of air; and feeding the expanded third portion of air to the lower pressure column.

3. A process as in claim 1, comprising the further steps of:

withdrawing an oxygen-enriched stream of liquid from the bottom of the higher pressure column;

feeding at least a portion of the oxygen-enriched stream of liquid to the lower pressure column; and withdrawing a nitrogen-enriched stream of vapor from the top of the lower pressure column.

4. A process as in claim 1, wherein the second pressure is lower than the first pressure by about 7 psia to about 8 psia.

5. A process as in claim 1, comprising the further steps of:

withdrawing a nitrogen-enriched stream from the higher pressure column;

expanding at least a portion of the nitrogen-enriched stream;

condensing the at least a portion of the nitrogen-enriched stream; and feeding at least a portion of the condensed at least a portion of the nitrogen-enriched stream to the lower pressure column.

6. A process as in claim 5, comprising the further steps of:

withdrawing an oxygen-enriched stream from the bottom of the higher pressure column;

vaporizing at least a portion of the oxygen-enriched stream by heat exchanging said at least a portion of the oxygen-enriched stream with the at least a portion of the nitrogen-enriched stream; and feeding the vaporized at least a portion of the oxygen-enriched stream to the lower pressure column.

7. A cryogenic air separation unit using a process as in claim 1.

8. A process as in claim 1, comprising the further steps of:

withdrawing a nitrogen-enriched stream from the top of the higher pressure column;

condensing the nitrogen-enriched stream in a reboiler-condenser;

returning a first portion of the condensed nitrogen-enriched stream to the higher pressure column; and feeding a second portion of the condensed nitrogen-enriched stream to the lower pressure column.

9. A process as in claim 1, comprising the further steps of:

warming a vaporized portion of the at least partially vaporized stream of liquid oxygen; and delivering the warmed vaporized portion to an end user.

10. A process as in claim 9, wherein the vaporized portion is delivered at a pressure between about 15 psia and about 27 psia.

11. A process as in claim 9, wherein the vaporized portion has a purity of at least about 85 mole %.

12. A process as in claim 1, wherein the stream of liquid oxygen withdrawn from the lower pressure column is elevated in pressure before being vaporized.

13. A process as in claim 1, wherein the first portion of air is compressed from the second pressure to the first pressure and is cooled before being fed to the higher pressure column.

14. A process as in claim 13, wherein the first portion of air is further compressed at a temperature colder than an ambient temperature.

15. A process as in claim 13, wherein at least some of the energy for further compressing the first portion of air is supplied by turbo-expanding another stream.

16. A process as in claim 14, wherein at least some of the energy for further compressing the first portion of air is supplied by turbo-expanding another stream.

17. A process as in claim 1, wherein the second portion of air is lowered to the second pressure by a turbo-expander.

18. A process as in claim 17, wherein the second portion of air entering the turbo-expander is at a temperature warmer than an ambient temperature.

19. A process as in claim 17, wherein the second portion of air is cooled before entering the turbo-expander.

20. A process as in claim 9, wherein the vaporized portion is delivered at a pressure between about 17 psia and about 23 psia.

* * * * *